US006742297B2

(12) United States Patent
Lakatos et al.

(10) Patent No.: US 6,742,297 B2
(45) Date of Patent: Jun. 1, 2004

(54) FIREARM RECOIL REDUCTION MECHANISM

(76) Inventors: Janos I. Lakatos, 345 W. 100 North #1, Logan, UT (US) 84341; E. Clay Slade, 1497 Highland Dr., North Logan, UT (US) 84341

( * ) Notice: Subject to any disclaimer, the term of this patent is extended or adjusted under 35 U.S.C. 154(b) by 204 days.

(21) Appl. No.: 09/909,398

(22) Filed: Jul. 19, 2001

(65) Prior Publication Data

US 2003/0200692 A1 Oct. 30, 2003

(51) Int. Cl.[7] ..... F41A 21/00

(52) U.S. Cl. ..... 42/1.06; 89/198; 89/14.3; 89/162

(58) Field of Search ..... 42/1.06; 89/198, 89/14.3, 162

(56) References Cited

U.S. PATENT DOCUMENTS 4,388,855 A * 6/1983 Sokolovsky ..... 89/198
4,485,723 A * 12/1984 Sarony ..... 89/163
4,522,107 A * 6/1985 Woodcock et al. ..... 89/196
5,069,110 A * 12/1991 Menck ..... 89/198
5,465,645 A * 11/1995 Cominolli ..... 89/198
5,549,030 A * 8/1996 Lespron ..... 89/14.3
5,811,714 A * 9/1998 Hull et al. ..... 89/14.3

* cited by examiner

*Primary Examiner*—J. Woodrow Eldred
(74) *Attorney, Agent, or Firm*—Workman Nydegger

(57) ABSTRACT

A mechanism embodying a shock absorber, gas spring, mechanical spring or other dampening device connected between slidably connected structural components of a firearm constitutes the basis of the firearm recoil reduction mechanism claimed in this application. The slidably connected structural components may be the firearm barrel, chamber, frame, action or stock. Discharge recoil force reduction is accomplished by connecting slidably connected structural components via a dampening device such as a gas spring/shock. As the relative motion between the slidably connected components progresses, the shock absorber/dampening device is activated resulting in energy adsorption, dispersion of the recoil over a longer time period, and attenuation of the total recoil force. The net recoil force is reduced as a result of the device. The device may be used concurrently with other recoil reduction devices such as muzzle brakes/compensators and automatic actions resulting in incrementally additive reductions to the net discharge recoil force transferred through the firearm.

13 Claims, 3 Drawing Sheets

FIREARM RECOIL REDUCTION MECHANISM

BACKGROUND OF THE INVENTION

1. Field of the Invention

The present invention is directed to the reduction of discharge recoil in a firearm.

2. Description of the Related Art

Since perhaps the thirteenth century when the first firearm was reportedly built, individuals have sought to reduce the discharge recoil and make firearms more manageable to discharge. The primary methods for accomplishing recoil reduction have followed two fundamental paths. The first method utilizes a muzzle brake and/or compensator. The muzzle brake was first employed on firearms during World War II and has been used since then as the primary method for firearm recoil reduction. There are several recent patents concerning muzzle brakes/compensators including: U.S. Pat. No. 4,715,140 by inventor Fred Rosenwald concerning a compensator for handguns, U.S. Pat. No. 5,036,747 by inventor Harry T. McClain III concerning a muzzle brake, U.S. Pat. No. 5,367,940 by inventor Henry A. Taylor concerning a combined muzzle brake, muzzle climb controller and noise redirector for firearms.

The principle upon which a muzzle brake functions is the creation of a force opposite to the discharge force through a mechanism to redirect gas flows from the end of the firearm barrel. A muzzle brake traditionally embodies a chamber attached to the end of the firearm barrel with a series of holes at an angle to the bore of the firearm. Upon discharge of the firearm, the projectile or bullet approaches the end of the barrel where the muzzle brake is attached. At this stage of the firing sequence, relatively high pressure gas is traveling down the barrel immediately behind the bullet at or near the velocity of the bullet. As the bullet or projectile passes through the muzzle brake, a portion of the gas trailing the bullet redirected through the holes in the chamber. The change in direction of the high pressure/high velocity gas causes a reaction force on the barrel which has a component that acts opposite to the recoil force. The resulting net force transferred through the firearm decreases as the muzzle brake induced force partially balances or cancels the discharge force.

The drawbacks to the muzzle brakes are two fold: first, the muzzle brake is limited to a 25 to 45 percent reduction in total recoil force. On large firearms, the reduction in recoil force required to make the firearm manageable often exceeds what is possible. The second problem with muzzle brakes is the magnitude and amplification of the noise that is created by the redirection of the gases as the pass through the chamber. Additionally, when the high pressure high velocity gas is redirected through the muzzle brake chamber, it is directed radially outward from the muzzle such that a larger area around the point of discharge is exposed to the redirected noise.

Another method for reducing recoil is a by-product of the chambering-firing-ejecting action developed for semi-automatic firearms. The first semi-automatic firearm was invented by John M. Browning in the 1890's. He invented several versions of automatic actions implemented on shot guns, rifles and handguns. While each type of firearm had a specific action, the general operational principles were the same. Like the muzzle brake, these automatic actions have been in use for long time and have been the subject of previous patents. Two recent patents of semi-automatic firearms are U.S. Pat. No. 4,892,026 by inventor Friedrich Aigner concerning a handheld automatic firearm, and U.S. Pat. No. 4,889,032 by inventor William J. Major concerning an automatic firearm. The principal behind the automatic firearm is the use of the reaction force of the high pressure gas developed upon discharge initiation to move the chambering mechanism and cartridge backward culminating in the ejection of the cartridge. Because the sliding mechanism moves at a force lower than the recoil force it results in a lower net force experienced by the person discharging the firearm.

The major problem with an automatic action is that it is inefficient in reducing total recoil force. Because the system is designed with the intent of ejecting a shell and not reducing recoil, the recoil reduction is not as large as it could be. A second problem results from the fact that it is an semi-automatic firearm; existing actions such as the single shot, bolt action, lever action, pump actions can not be adapted to benefit from the inherent reduction in recoil force.

SUMMARY OF THE INVENTION

The present invention solves the force reduction limitations of both the muzzle brake/compensator and the automatic/semi-automatic actions. It yields no increase in noise level or change in noise direction while reducing the total discharge recoil force. When tuned for a specific firearm, it can be very effective in reducing the net recoil force to a fraction of the initial recoil force. It can be applied to any firearm design including the single shot, pump action, bolt action and semi-automatic designs of all types of firearms including shotguns, rifles and pistols. It is specific to recoil force magnitude reduction. Its design is based on distributing the total recoil energy over time resulting in lower total magnitude of recoil force. It can be tuned or optimized to each firearm and the corresponding design criteria are based on the desired total recoil reduction. The invention can be used in conjunction with a muzzle brake/compensator, a semi-automatic firearm or other mechanisms designed to reduce the net recoil force.

In one embodiment, a barrel with a cartridge chamber is slidably connected to a frame, which has a shock absorber, spring or other dampening device connected to both the frame and the barrel. As the firearm is discharged the reaction force of the high pressure gas causes the barrel to slide relative to the frame. As the barrel slides, the shock absorber (or spring or other dampening device) is activated by the relative motion between the frame and the sliding barrel. The shock absorber consumes energy and distributes the discharge force over a tunable period of time resulting in a decrease in the peak magnitude of the recoil force.

In another embodiment, the stock of the firearm is separated into two pieces which are slidably connected to each other with a shock, spring or other dampening device connected to both pieces. As the firearm is discharged the reaction force of the high pressure gas causes the two pieces of the stock to slide relative to each other. As the stock pieces slide, the shock absorber (or spring or other dampening device) is activated by the relative motion between the pieces. The shock absorber consumes energy and distributes the discharge force over a tunable period of time resulting in a decrease in the peak magnitude of the recoil force.

In a fourth embodiment, the chamber containing the cartridge is slidably connected to the firearm frame with a shock, spring or other dampening device connected to both the firearm and the chamber. As the firearm is discharged the reaction force of the high pressure gas causes the chamber to slide relative to the frame. As the stock pieces slide, the shock absorber (or spring or other dampening device) is activated by the relative motion between the chamber and the frame. The shock absorber consumes energy and distributes the discharge force over a tunable period of time resulting in a decrease in the peak magnitude of the recoil force.

In another embodiment, a barrel with a cartridge chamber is slidably connected to a frame, which has a shock absorber, spring or other dampening device connected to both the frame and the barrel and the barrel end has a muzzle brake or compensator attached. As the firearm is discharged the reaction force of the high pressure gas causes the barrel to slide relative to the frame. As the barrel slides, the shock absorber (or spring or other dampening device) is activated by the relative motion between the frame and the sliding barrel. The shock absorber consumes energy and distributes the discharge force over a tunable period of time resulting in a decrease in the peak magnitude of the recoil force. Additionally, the muzzle brake/compensator redirects the high pressure/high velocity gas as it passes through the brake chamber resulting in an additional reduction in net recoil force. This embodiment illustrates the use of the current invention concurrent with one of the other recoil reduction mechanisms. The current invention can be used concurrently with automatic/semi-automatic actions, muzzle brakes/compensators and recoil pads to incrementally reduce the net recoil force.

BRIEF DESCRIPTION OF THE DRAWINGS

The accompanying drawings show embodiments of the invention as follows.

DETAILED DESCRIPTION OF THE INVENTION

It is not intended for the invention as disclosed in this patent be limited by anything other than the claims. This section is meant to describe a few embodiments and the particular elements as shown in the illustrations. Anyone having a knowledge of firearms and firearm design would recognize that many of the materials, components and configurations can be modified from the present drawings to accomplish the present invention.

For the purpose of this document, the terms "automatic" and "semi-automatic" are considered to have the same meaning. The terms are intended to describe a firearm that is capable of discharging multiple rounds by either holding the trigger or pressing the trigger multiple times.

Figure 1:
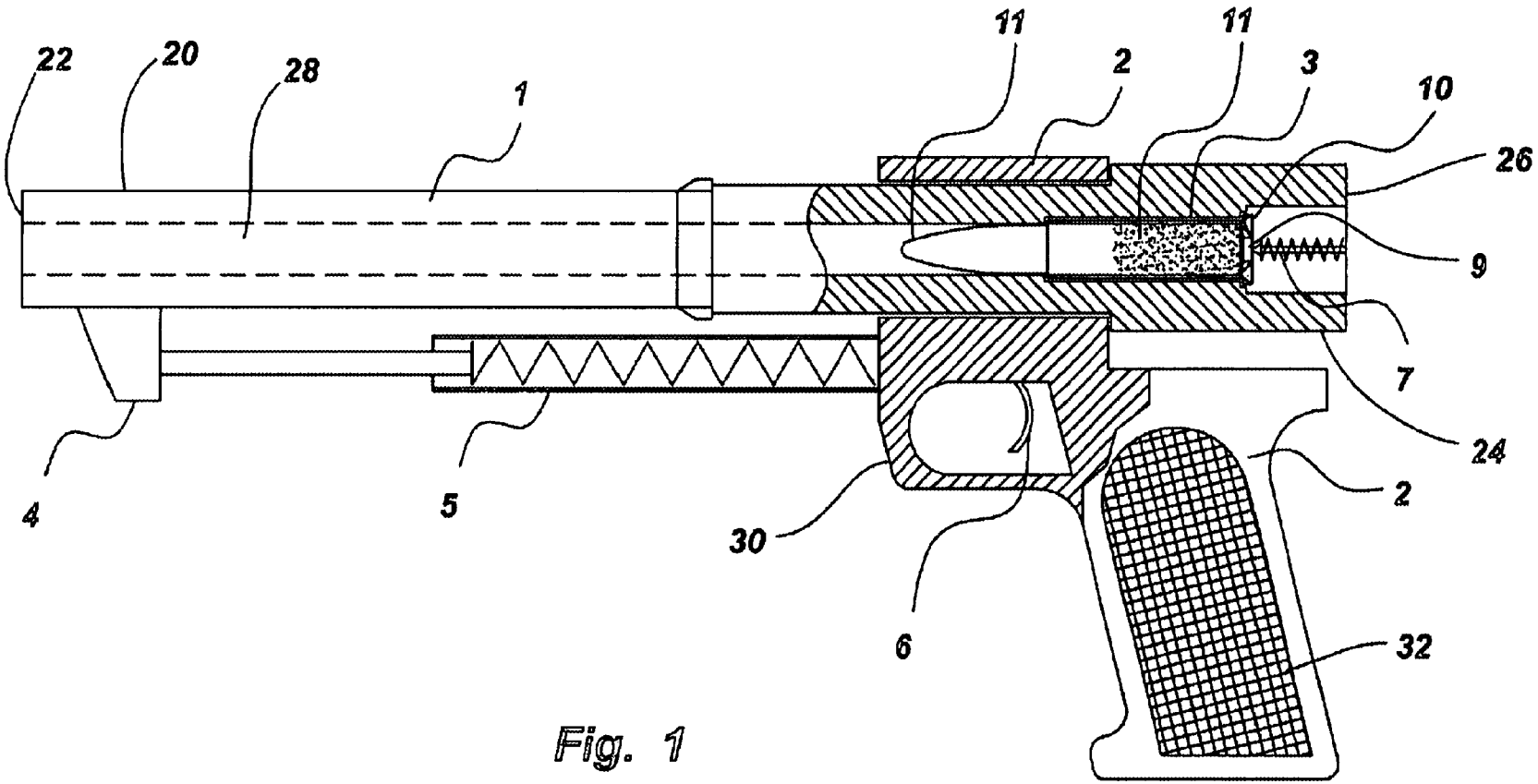
FIG. 1 shows one embodiment of the invention in which a barrel is slidably connected to a frame, which has a shock, spring or other dampening device connected to both the frame and the barrel.

In the embodiment as illustrated in FIG. 1 the barrel (1) is slidably connected to frame (2). The barrel (1) has a forward end (20) that terminates at a forward end face (22) and an opposing rearward end (24) that terminates at a rearward end face (26). The barrel (1) bounds a bore (28) that openly extends through forward end face (22). The frame (2) includes a trigger guard portion (30) and a hand grip portion (32). The dampening device (5) is connected to both the frame (2) and the barrel (1) either directly or through an adapter (4). The dampening device (5) includes a shock absorber, a mechanical spring, a gas spring or other dampening device.

The trigger assembly (6) is activated causing the firing pin (7) to strike the primer (9) located within the shell (10) which is the chamber (3) causing the gun powder (11) to ignite. The burning gun powder (11) creates a pressure which propels the projectile (12) outward towards the end of the barrel (1). As the pressure is pushing the projectile (12) outward it also creates a reaction force which acts on the barrel (1) causing it to move relative to the frame (2). Specifically, the barrel (1) moves from a forward position as shown in FIG. 1 to a recoiled position wherein barrel (1) is moved rearward relative to frame (2). The relative motion actuates a shock, spring, or other dampening device (5) connected to both the frame (2) and the barrel (1). The shock, spring or other dampening device (5), connected to both the frame (2) and the barrel (2), consumes energy, attenuates the peak recoil force and distributes the recoil force over a longer time period resulting in a net reduction in recoil force transferred through the firearm.

Figure 2:
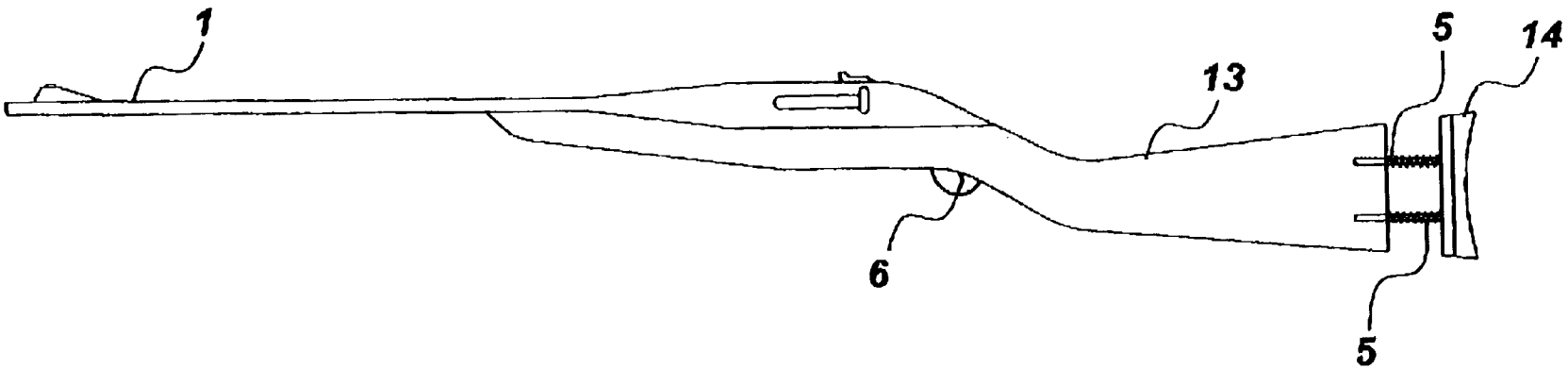
FIG. 2 shows one embodiment of the invention in which the stock of the firearm is separated into two pieces that are slidably connected to each other through a shock, spring or other dampening device.

In the embodiment as illustrated by FIG. 2, the main stock (13) is slidably connected to an outer stock (14) and has a shock, spring or other dampening device (5) connected to both the main stock (13) and outer stock (14) either directly or through an adapter (4). As the trigger assembly (6) is activated causing the firing pin (7) to strike the primer (9) located within the shell (10) which is in the chamber (3) causing the gun powder (11) to ignite, the burning gun powder creates a pressure which propels the projectile (12) outward towards the end of the barrel (1). As the pressure is pushing the projectile (12) outward it also creates a reaction force which acts on the main stock (13) causing it to move relative to the outer stock (14). The relative movement actuates a shock, spring or other dampening device (5) connected to both the main stock (13) and the outer stock (14). The shock, spring or other dampening device (5), connected to both the main stock (13) and the outer stock (14), consumes energy and disperses the recoil energy over time which results in a reduction of recoil force transferred to the outer stock (14).

Figure 3:
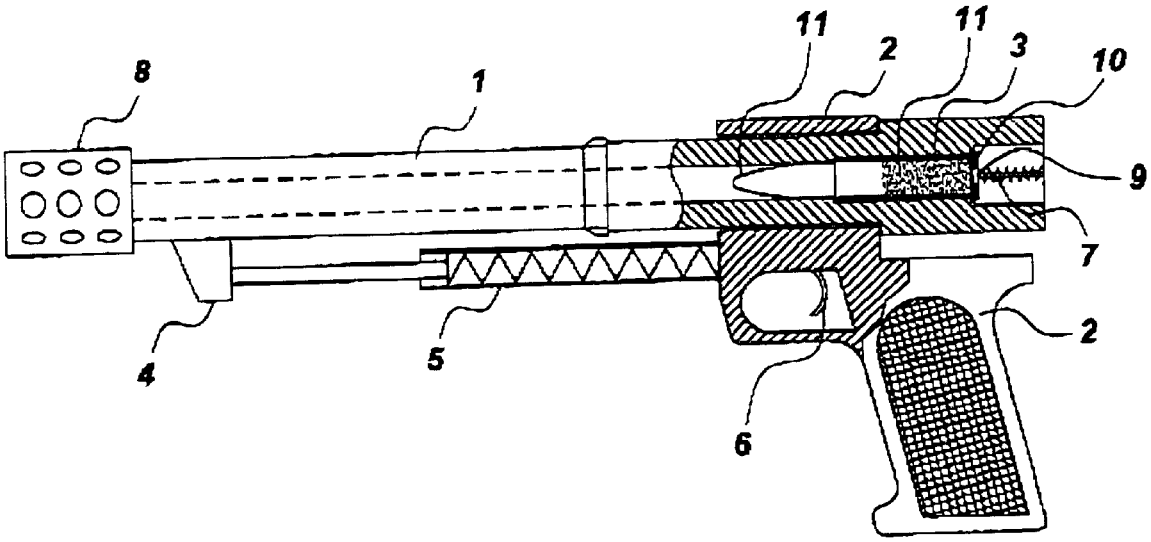
FIG. 3 shows another embodiment in which a barrel is slidably connected to a frame which has a shock, spring or other dampening device connected to both the frame and the barrel used in conjunction with a muzzle brake. This illustrates the current invention used in conjunction with the most common current recoil systems.

In yet another embodiment, as illustrated by FIG. 3, the barrel (1) is slidably connected to frame (2), and has a shock, spring or other dampening device (5) connected to both the frame (2) and the barrel (1) either directly or through an adapter (4). As the trigger assembly (6) is activated causing the firing pin (7) to strike the primer (9) located within the shell (10) which is in the chamber (3) causing the gun powder (11) to ignite, the burning gun powder (11) creates a pressure which propels the projectile (12) outward towards the end of the barrel (1). As the pressure is pushing the projectile (12) outward it also creates a reaction force which acts on the barrel (1) causing it to move relative to the frame (2). The relative movement actuates a shock, spring or other dampening device (5) connected to both the frame (2) and the barrel (1). The shock, spring or other dampening device (5), connected to both the frame (2) and the barrel (1), consumes energy, distributes the recoil energy over time and attenuates the peak recoil force. This results in a net reduction of the magnitude of recoil force transferred to the frame (2). As the projectile leaves the barrel (1) and muzzle brake

(8), the high pressure/high velocity gas is redirected inside the muzzle brake (8) causing the net recoil force transferred to the frame (2) to decrease even further.

We claim:

1. A firearm comprising:

a frame comprising a hand grip portion and a trigger guard portion;

a barrel having a forward end that terminates at a forward end face and an opposing rearward end that terminates at a rear end face, the barrel bounding a bore openly extending through the forward end face, the bore being adapted to receive a projectile, the barrel being slidably mounted on the frame so that the barrel moves relative to the frame from a forward position to a recoiled position as a discharge force is produced by the projectile being discharged from the barrel, the rear end face of the barrel being openly exposed and disposed rearward of the hand grip portion of the frame when the barrel is in the recoiled position; and a damping device mounted to the frame and the barrel, the damping device damping the discharge force as the barrel moves between the forward position and the recoiled position.

2. A firearm as recited in claim 1, wherein the rearward end face of the barrel is openly exposed within the barrel is in the forward position and the recoiled position.

3. A firearm as recited in claim 1, wherein the frame encircles a section of the barrel such that at least a portion of the forward end of the barrel and the rearward end of the barrel is openly exposed when the barrel is in both the forward position and the recoiled position.

4. A firearm as recited in claim 1, wherein the damping device comprises a shock absorber, a mechanical spring, or a gas spring.

5. A firearm as recited in claim 1, wherein the barrel is exclusively designed to receive a single projectile that must be manually replaced after discharge.

6. A firearm as recited in claim 2, wherein the barrel is exclusively designed to receive a single projectile that must be manually replaced after discharge.

7. A firearm as recited in claim 3, wherein the barrel is exclusively designed to receive a single projectile that must be manually replaced after discharge.

8. A firearm as recited in claim 1, further comprising a muzzle brake mounted to the barrel.

9. A firearm as recited in claim 1, further comprising a trigger assembly mounted to the frame.

10. A firearm as recited in claim 1, wherein the barrel comprises a single integral member.

11. A firearm as recited in claim 6, wherein the barrel comprises a single integral member.

12. A firearm as recited in claim 7, wherein the barrel comprises a single integral member.

13. A firearm as recited in claim 1, wherein the rear end face of the barrel is aligned with the hand grip portion of the frame when the barrel is in the forward position.

* * * * *

UNITED STATES PATENT AND TRADEMARK OFFICE

CERTIFICATE OF CORRECTION

PATENT NO. : 6,742,297 B2
DATED : June 1, 2004
INVENTOR(S) : Janos I. Lakatos and E. Clay Slade It is certified that error appears in the above-identified patent and that said Letters Patent is hereby corrected as shown below:

Column 1,
Line 39, insert -- is -- before "redirected through"

Column 4,
Line 24, change "barrel (2)" to -- barrel (1) --

Column 5,
Line 25, change "within" to -- when --

Signed and Sealed this

Third Day of August, 2004

JON W. DUDAS
*Acting Director of the United States Patent and Trademark Office*